US006089028A

United States Patent [19]

Bowen et al.

[11] Patent Number: 6,089,028

[45] Date of Patent: Jul. 18, 2000

[54] PRODUCING POWER FROM PRESSURIZED LIQUEFIED NATURAL GAS

[75] Inventors: Ronald R. Bowen, Magnolia; Moses Minta, Sugar Land, both of Tex.

[73] Assignee: ExxonMobil Upstream Research Company, Houston, Tex.

[21] Appl. No.: 09/280,110

[22] Filed: Mar. 26, 1999

Related U.S. Application Data

[60] Provisional application No. 60/079,643, Mar. 27, 1998.

[51] Int. Cl.[7] ..... F17C 9/02

[52] U.S. Cl. ..... 62/50.2

[58] Field of Search ..... 62/50.2, 619

[56] References Cited

U.S. PATENT DOCUMENTS

| | | | |
|---|---|---|---|
| 2,975,607 | 3/1961 | Bodle | 62/52 |
| 3,068,659 | 12/1962 | Marshall, Jr. | 62/52 |
| 3,183,666 | 5/1965 | Jackson | 60/38 |
| 3,203,191 | 8/1965 | French | 62/9 |
| 3,405,530 | 10/1968 | Denahan et al. | 62/28 |
| 3,452,548 | 7/1969 | Pitaro | 62/53 |
| 3,479,832 | 11/1969 | Sarsten et al. | 62/52 |
| 3,978,663 | 9/1976 | Mandrin et al. | 60/39.67 |
| 3,992,891 | 11/1976 | Pocrnja | 62/53 |
| 4,320,303 | 3/1982 | Ooka et al. | 290/1 R |
| 4,400,947 | 8/1983 | Ruhemann | 60/648 |
| 4,429,536 | 2/1984 | Nozawa | 60/655 |
| 4,437,312 | 3/1984 | Newton et al. | 60/648 |
| 4,444,015 | 4/1984 | Matsumoto et al. | 60/648 |
| 4,479,350 | 10/1984 | Newton et al. | 60/655 |
| 5,400,588 | 3/1995 | Yamane et al. | 60/39.465 |
| 5,457,951 | 10/1995 | Johnson et al. | 60/39.02 |

OTHER PUBLICATIONS

L. L. Johnson and G. Renaudin, 'Liquid turbines' improve LNG Operations; Oil and Gas Journal, Nov. 1996, pp. 31–32 and 35–36.

H. Kashimura, et al., Power generator using cold potential of LNG in multicomponent fluid rankine cycle, Seventh International Conference on Liquefied Natural Gas, May 15–19, 1983, pp. 2–14.

S. H. Chansky and J. E. Haley, How to use the cold in LNG, The Magazine of Gas Distribution, Aug. 1968, pp. 42–47.

*Primary Examiner*—Henry Bennett
*Assistant Examiner*—Malik N. Drake
*Attorney, Agent, or Firm*—Gary D. Lawson

[57] ABSTRACT

A process for using the cold of pressurized liquefied natural gas (PLNG) to compress boil-off vapors produced by handling of liquefied natural gas to produce a higher pressure gas product and at the same time produce power that preferably provides at least part of the power for the process. The PLNG is pressurized, passed to a first heat exchanger for vaporization, and the vaporous material is passed to a second heat exchanger for further heating to produce a first gas product. A refrigerant is circulated in a closed cycle through the first heat exchanger to heat the PLNG, through a pump to pressurize the refrigerant, through a second heat exchanger to vaporize the refrigerant, and through a work-producing device to generate energy. Boil-off gas is compressed and passed through the first heat exchanger, further compressed, and then passed through the second heat exchanger to produce a second gas product.

10 Claims, 2 Drawing Sheets

PRODUCING POWER FROM PRESSURIZED LIQUEFIED NATURAL GAS

This application claims the benefit of U.S. Provisional Application Ser. No. 60/079,643, filed Mar. 27, 1998.

FIELD OF THE INVENTION

This invention relates generally to a process for regasification of liquefied natural gas, and more particularly relates to a process of regasifying pressurized liquefied natural gas (PLNG) to produce by-product power by economic use of the available liquefied natural gas cold sink.

BACKGROUND OF THE INVENTION

Natural gas is often available in areas remote to where it will be ultimately used. Quite often the source of this fuel is separated from the point of use by a large body of water and it may then prove necessary to transport the natural gas by large vessels designed for such transport. Natural gas is normally transported overseas as cold liquid in carrier vessels. At the receiving terminal, this cold liquid, which in conventional practice is at near atmospheric pressure and at a temperature of about −160° C. (−256° F.), must be regasified and fed to a distribution system at ambient temperature and at a suitable elevated pressure, generally around 80 atmospheres. This requires the addition of a substantial amount of heat and a process for handling LNG vapors produced during the unloading process. These vapors are sometimes referred to as boil-off gases.

Many different processes have been proposed for handling boil-off gases produced during LNG unloading. The amount of boil-off gases can be significant, particularly if the LNG is unloaded at higher pressures. In some LNG unloading processes, the vapor left in the storage container can constitute up to about 25% of the product mass, depending on the LNG pressure and composition. One option for recovering the boil-off vapor is to pump it out of the storage container for use as a natural gas product. The horsepower required to run evacuation pumps increases and is an added expense to the overall expense of a LNG unloading process. The industry has a continuing interest in processes that minimize the horsepower requirements of making the boil-off vapors available for commercial use.

Many suggestions have also been made and some installations have been built to use the large cold potential of the LNG. Some of these processes use the LNG vaporization process to produce by-product power as a way of using the available LNG cold. The available cold is used by using as a hot sink energy sources such as seawater, ambient air, low-pressure steam and flue gas. The heat-transfer between the sinks is effected by using a single component or multi-component heat-transfer medium as the heat exchange medium. For example, U.S. Pat. No. 4,320,303 uses propane as a heat-transfer medium in a closed loop process to generate electricity.

The LNG liquid is vaporized by liquefying propane, the liquid propane is then vaporized by seawater, and the vaporized propane is used to power a turbine which drives an electric power generator. The vaporized propane discharged from the turbine then warms the LNG, causing the LNG to vaporize and the propane to liquefy.

Although the use of LNG as a cold sink is known in the art, there is a continuing need for an improved process that uses the cold sink of the liquefied natural gas and at the same time economically and efficiently processes boil-off gases from liquid natural gas for use as a product.

SUMMARY

The present invention provides an improved process for regasifying a pressurized liquefied gas (PLNG) and simultaneously producing a gas product from boil-off vapors produced by the liquefied gas and simultaneously producing energy.

Boil-off vapors are recovered from a storage and/or handling facility and are compressed by one or more compressors. After compression, the boil-off vapors are cooled in a first heat exchanger. The cooled boil-off vapors are then further compressed. The boil-off vapors are then heated in a second heat exchanger. The pressurized liquefied gas to be regasified is further pressurized, preferably to the desired pressure of the regasified product. The pressurized liquid is then passed to the first heat exchanger wherein the pressurized liquid is heated in part by the compressed boil-off vapors and is at least partially regasified. This pressurized gas is then passed to a second heat exchanger to further heat the pressurized gas and to produce a pressurized gaseous product. The process of this invention simultaneously produces energy by circulating in a closed power cycle through the first and second heat exchange means a first heat-exchange medium, the process of the closed cycle comprising the steps of (1) passing to the first heat exchanger the first heat-exchange medium in heat exchange with the pressured boil-off gas phase and in heat exchange with the liquefied gas to at least partially liquefy the first heat-exchange medium; (2) pressurizing the at least partially liquefied first heat-exchange medium by pumping; (3) passing the pressurized first heat-exchange medium of step (2) through the first heat exchange means to at least partially vaporize the liquefied first heat-exchange medium; (4) passing the first heat-exchange medium of step (3) to the second heat exchanger to further heat the first heat-exchange medium by heat exchange with an external second heat exchange medium to produce a pressurized vapor; (4) passing the vaporized first heat-exchange medium of step (3) through an expansion device to expand the first heat-exchange medium vapor to a lower pressure whereby energy is produced; (5) passing the expanded first heat-exchange medium of step (4) to the first heat exchanger; and (6) repeating steps (1) through (5).

The practice of this invention provides a source of power to meet the compression horsepower needed to evacuate boil-off gases from a storage vessel and it minimizes the overall compression horsepower of the liquid-to-gas conversion process.

BRIEF DESCRIPTION OF THE DRAWINGS

The present invention and its advantages will be better understood by referring to the following detailed description and the attached Figures, which are schematic flow diagrams of representative embodiments of this invention.

The flow diagrams illustrated in the Figures present various embodiments of practicing the process of this invention. The Figures are not intended to exclude from the scope of the invention other embodiments that are the result of normal and expected modifications of these specific embodiments. Various required subsystems such as valves, control systems, and sensors have been deleted from the Figures for the purposes of simplicity and clarity of presentation.

DETAILED DESCRIPTION OF THE INVENTION

This process of this invention uses the cold of pressurized liquefied natural gas (PLNG) to compress boil-off vapors produced by the handling of the liquefied natural gas to produce a gas product and to provide a power cycle that preferably provides power for the process. In the present invention, the overall compression energy requirements of compressing the boil-off vapors to a product pressure can be substantially reduced by having at least two compression stages with cooling between the compression stages. The cooling is provided by the cold of the pressurized liquid natural gas.

Figure 1:
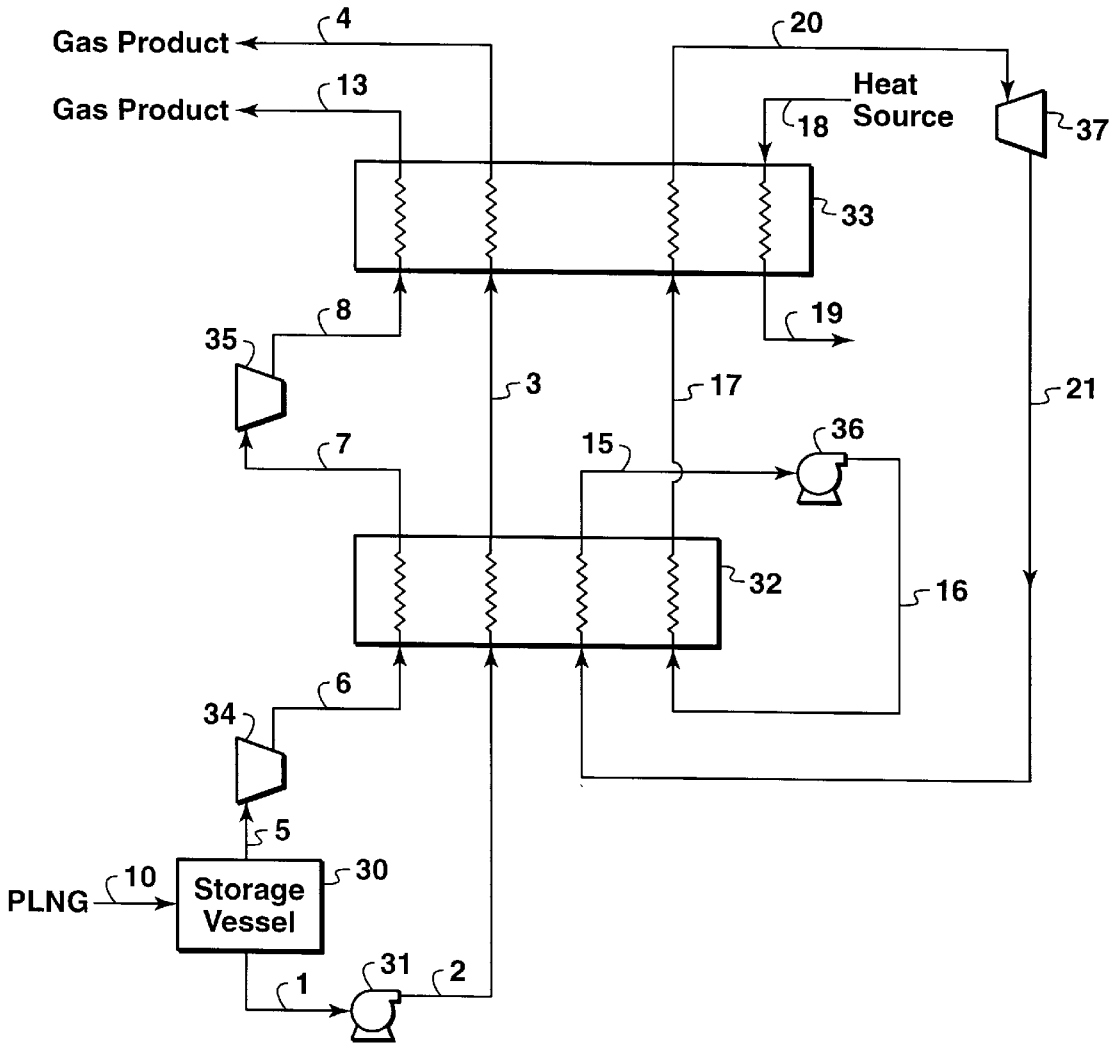
FIG. 1 is a schematic flow diagram of one embodiment of this invention showing a process to regasify LNG.

Referring to FIG. 1, reference character 10 designates a line for feeding PLNG to an insulated storage vessel 30. The storage vessel 30 can be an onshore stationary storage vessel or it can be a container on a ship. Line 10 may be a line used to load storage vessels on a ship or it can be a line extending from a container on the ship to an onshore storage vessel. In the practice of this invention, PLNG in storage vessel 30 will typically be at a pressure above about 1724 kPa (250 psia) and a temperature below about −82° C. (−116° F.), and preferably between about −90° C. (−130° F.) and −105° C. (−157° F.).

Although a portion of the PLNG in vessel 30 will boil off as a vapor during storage and during unloading of storage containers, the major portion of the PLNG in vessel 30 is fed through line 1 to a suitable pump 31 to pressurize the liquefied gas to a predetermined pressure, preferably to the pressure at which it is desired to use the vaporized natural gas or at the pressure suitable for transport through a pipeline. The pressure discharge from the pump 31 will normally range from about 4,137 kPa (600 psia) to 10,340 kPa (1,500 psia), and more typically will range between about 6,200 kPa (900 psia) and 7,580 kPa (1,100 psia).

The liquefied natural gas discharged from the pump 31 is directed by line 2 through heat exchanger 32 to at least partially vaporize the PLNG. The pressurized natural gas exiting exchanger 32 is directed by line 3 through a second heat exchanger 33 to further heat the natural gas stream. The revaporized natural gas is then directed by line 4 to a suitable distribution system for use as fuel or for transportation through a pipeline or the like.

The vapor boil-off or overhead from the storage vessel 30 is directed by line 5 to a compressor 34 to increase the pressure of the vapor. Although FIG. 1 shows boil-off vapors coming from storage vessel 30, which is the same storage vessel as the liquefied natural gas to be regasified, the boil-off vapors can come from other sources such as vapors generated during the filling of ships and other carriers or storage vessels with liquefied gas. From the compressor 34, the pressurized vapor is directed by line 6 to heat exchanger 32 to cool the vapor. The cooled vapor is directed by line 7 to a second compressor 35 to further increase the pressure of the vapor, preferably to the pressure of the gas product in line 4. The vapor from compressor 35 is then directed by line 8 to heat exchanger 33 for re-cooling and is discharged through line 13 for use as a pressurized natural gas product. Preferably the natural gas in line 13 is combined with the gas product in line 4 for delivery to a pipeline or other suitable use.

A heat-transfer medium is circulated in a closed-loop cycle. The heat-transfer medium is passed from the first heat exchanger 32 by line 15 to a pump 36 in which the pressure of the heat-transfer medium is raised to an elevated pressure. The pressure of the cycle medium depends on the desired cycle properties and the type of medium used. From pump 36 the heat-transfer medium, which is in liquid condition and at the elevated pressure, is passed through line 16 to heat exchanger 32 wherein the heat-transfer medium is heated. From the heat exchanger 32, the heat-transfer medium is passed by line 17 to heat exchanger 33 wherein the heat-transfer medium is further heated.

Heat from any suitable heat source is introduced to heat exchanger 33 by line 18 and the cooled heat source medium exits the heat exchanger through line 19. Any conventional low cost source of heat can be used; for example, ambient air, ground water, seawater, river water, or waste hot water or steam. The heat from the heat source passing through the heat exchanger 33 is transferred to the heat-transfer medium. This heat-transfer causes the gasification of the heat-transfer medium, so it leaves the heat exchanger 33 by line 20 as a gas of elevated pressure. This gas is passed through line 20 to a suitable work-producing device 37. Device 37 is preferably a turbine, but it may be any other form of engine, which operates by expansion of the vaporized heat-transfer medium. The heat-transfer medium is reduced in pressure by passage through the work-producing device 37 and the resulting energy may be recovered in any desired form, such as rotation of a turbine which can be used to drive electrical generators or to drive compressors (such as compressors 34 and 35) and pumps (such as pumps 31 and 36) used in the regasification process.

The reduced pressure heat-transfer medium is directed from the work-producing device 37 through line 21 to the first heat exchanger 32 wherein the heat-transfer medium is at least partially condensed, and preferably entirely condensed, and the LNG is vaporized by a transfer of heat from the heat-transfer medium to the LNG. The condensed heat-transfer medium is discharged from the heat exchanger 33 through line 15 to the pump 36, whereby the pressure of the condensed heat-transfer medium is substantially increased.

The heat-transfer medium may be any fluid having a freezing point below the boiling temperature of the pressurized liquefied natural gas, does not form solids in heat exchangers 32 and 33, and which in passage through heat exchangers 32 and 33 has a temperature above the freezing temperature of the heat source but below the actual temperature of the heat source. The heat-transfer medium may therefore be in liquid form during its circulation through heat exchangers 32 and 33 to provide a transfer of sensible heat alternately to and from the heat-transfer medium. It is preferred, however, that the heat-transfer medium be used which goes through at least partial phase changes during circulation through heat exchangers 32 and 33, with a resulting transfer of latent heat.

The preferred heat-transfer medium has a moderate vapor pressure at a temperature between the actual temperature of the heat source and the freezing temperature of the heat source to provide a vaporization of the heat-transfer medium during passage through heat exchangers 32 and 33. Also, the heat-transfer medium, in order to have a phase change, must be liquefiable at a temperature above the boiling temperature of the pressurized liquefied natural gas, such that the heat-transfer medium will be condensed during passage through heat exchanger 32. The heat-transfer medium can be a pure compound or a mixture of compounds of such composition that the heat-transfer medium will condense over a range of temperatures above the vaporizing temperature range of the liquefied natural gas.

Although commercial refrigerants may be used as heat-transfer mediums in the practice of this invention, hydrocarbons having 1 to 6 carbon atoms per molecule such as propane, ethane, and methane, and mixtures thereof, are preferred heat-transfer mediums, particularly since they are normally present in at least minor amounts in natural gas and therefore are readily available.

Figure 2:
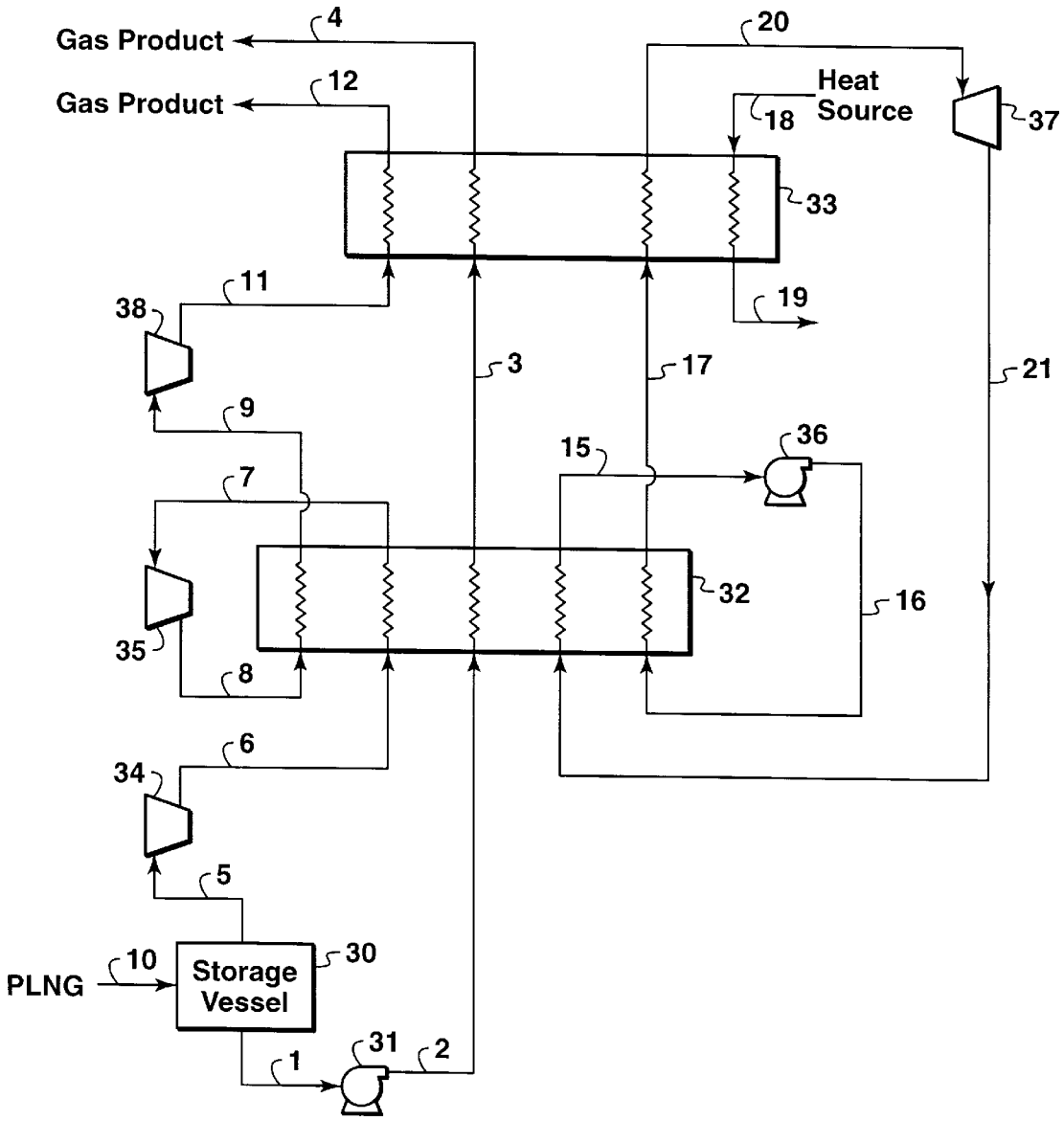
FIG. 2 is a schematic flow diagram of a second embodiment of this invention.

FIG. 2 illustrates another embodiment of the invention and in this embodiment the parts having like numerals to those in FIG. 1 have the same process functions. Those skilled in the art will recognize, however, that the process equipment from one embodiment to another may vary in size and capacity to handle different fluid flow rates, temperatures, and compositions. The process illustrated in FIG. 2 is substantially the same as the process illustrated in FIG. 1 except for the compression and cooling of the vapor stream exiting storage vessel 30. In FIG. 2, the vapor stream is subjected to three compression stages by compressors 34, 35, and 38 to increase the pressure of vapor in line 5 in three stages, preferably to approximately the same pressure of the vapor in line 4. Referring to FIG. 2, stream 5 is passed to the first compressor 34 and the compressed vapor is passed by line 6 through heat exchanger 32 to cool the vapor in line 6. The vapor exiting the heat exchanger 32 is directed (line 7) to the second compressor 35 to further increase the pressure of the vapor. From compressor 35 the vapor is passed by line 8 through heat exchanger 32 for re-cooling. From heat exchanger 32 the cooled vapor is then passed by line 9 to the third compressor 38 which increases the pressure to the desired final pressure. From compressor 38 the compressed natural gas is directed by line II through heat exchanger 33 to heat the natural gas, which may then be passed by line 12 to a suitable product distribution system.

In the process of compressing the gas vapor by the train of compressors 34, 35, and 38, the compression increases by these compressors is preferably not the same. Since the final discharge pressure from compressor 38 will often be above the critical pressure of the fluid being compressed, compressor 38 may be compressing a dense phase fluid which requires less horsepower to compress than an equivalent amount of vapor. If compressor 38 is compressing a dense fluid, the pressure ratio for compressor 38 is preferably higher than the pressure ratios for compressors 34 and 35. If the last compression stage compresses a dense phase fluid, the overall horsepower requirements of the compression train will be minimized by having the last compressor in the train bear the greater compression duty. However, if the compression in the last compression stage is not above the critical pressure of the fluid being compressed, no significant benefit is gained by having the pressure ratio for the last compressor higher than the pressure ratios for the other compressors. The optimum pressure value for each stage can be readily determined by persons skilled in the art using commercially available process simulators.

EXAMPLE

A simulated mass and energy balance was carried out to illustrate the embodiment of the invention as described by FIG. 2, and the results are set forth in Table 1 and Table 2 below. The data in the Tables assumed a PLNG production rate of about 752 MMSCFD and a heat-transfer medium comprising a 50%–50% methane-ethane binary mixture. Inlet conditions for vapor stream 5 is taken as the geometric average between initial and final pressure and temperature conditions of the storage vessel 30. The data in the Tables were obtained using a commercially available process simulation program called HYSYS™. However, other commercially available process simulation programs can be used to develop the data, including for example HYSIM™, PROII™, and ASPEN PLUS™, which are familiar to persons skilled in the art The data presented in the Tables are offered to provide a better understanding of the present invention, but the invention is not to be construed as unnecessarily limited thereto. The temperatures and flow rates are not to be considered as limitations upon the invention which can have many variations in temperatures and flow rates in view of the teachings herein.

TABLE 1

| | Phase | Pressure | | Temperature | | Total Flow | |
|---|---|---|---|---|---|---|---|
| Stream | Vapor/Liquid | kPa | psia | °C. | °F. | kgmole/hr | MMSCF*D* |
| 1 | L | 3,401 | 441 | −96 | −141 | 33,824 | 679 |
| 2 | L | 7,095 | 1,029 | −88 | −126 | 33,824 | 679 |
| 3 | V | 7,095 | 1,029 | −39 | −38 | 33,824 | 679 |
| 4 | V | 7,095 | 1,029 | 16 | 61 | 33,824 | 679 |
| 5 | V | 834 | 121 | −96 | −141 | 3,735 | 75 |
| 6 | V | 1,703 | 247 | −49 | −56 | 3,735 | 75 |
| 7 | V | 1,703 | 247 | −84 | −119 | 3,735 | 75 |
| 8 | V | 3,475 | 504 | −35 | −31 | 3,735 | 75 |
| 9 | V | 3,475 | 504 | −84 | −119 | 3,735 | 75 |
| 11 | V | 7,095 | 1,029 | −38 | −36 | 3,735 | 75 |
| 12 | V | 7,095 | 1,029 | 16 | 61 | 3,735 | 75 |
| 15 | L | 2,200 | 319 | −84 | −119 | 56,235 | 1,129 |
| 16 | L | 4,199 | 609 | −83 | −117 | 56,235 | 1,129 |
| 17 | V/L | 4,199 | 609 | −18 | 0 | 56,235 | 1,129 |
| 20 | V | 4,199 | 609 | 22 | 72 | 56,235 | 1,129 |
| 21 | V | 2,200 | 319 | −15 | 5 | 56,235 | 1,129 |

*Million standard cubic feet per day

Table 2 compares the horsepower requirements of compressors 34, 35, and 38 and pumps 31 and 36 in two simulated cases: Case 1 was without interstage cooling and Case 2 was with interstage cooling. In Case 1, it was assumed that boil-off gas was compressed by compressors 34, 35, and 38 without having the boil-off vapor pass through heat exchanger 32. In Case 2, the boil-off vapor was processed in accordance with the practice of this invention as illustrated by the embodiment shown in FIG. 2.

TABLE 2

| | Case 1-Power requirement without interstage cooling. | Case 2-Power requirement with interstage cooling. |
|---|---|---|
| Compressor 34 | 1,462 kW (1,960 hp) | 1,462 kW (1,960 hp) |
| Compressor 35 | 1,836 kW (2,462 hp) | 1,433 kW (1,922 hp) |
| Compressor 38 | 2,316 kW (3,106 hp) | 1,090 kW (1,462 hp) |
| Subtotal | 5,614 kW (7,528 hp) | 3,985 kW (5,344 hp) |
| Pump 31 | 2,834 kW (3,800 hp) | 2,834 kW (3,800 hp) |
| Pump 36 | 2,201 kW (2,952 hp) | 2,201 kW (2,952 hp) |
| Total (energy consumed) | 10,649 kW (14,280 hp) | 9,020 kW (12,096 hp) |
| Turbine 37 (energy produced) | 14,719 kW (19739 hp) | 14,713 kW (19,730 hp) |

The data in Table 2 show that the practice embodiment depicted in FIG. 2 (Case 2) requires 15% less power (9,020 kW versus 10,649 kW) than the total power requirements of Case 1. In both Case 1 and Case 2, the turbine 37 produced more power than required to run the compressors and pumps. Cooling the boil-off vapor (streams 6 and 8 in FIG. 2) to −84° C. (−119° F.) before entering compressors 35 and 38 substantially reduces the horsepower requirements for compression. In addition, the boil-off gas provides part of the heating duty in heat exchanger 32 for warming the liquid gas in stream 2.

A person skilled in the art, particularly one having the benefit of the teachings of this patent, will recognize many modifications and variations to the specific process disclosed above. For example, a variety of temperatures and pressures may be used in accordance with the invention, depending on the overall design of the system and the composition, temperature, and pressure of the liquefied natural gas. As discussed above, the specifically disclosed embodiments and examples should not be used to limit or restrict the scope of the invention, which is to be determined by the claims below and their equivalents.

What is claimed is:

1. A process for recovering power in which liquefied natural gas is gasified and the cold potential thereof is utilized, comprising the steps of:

(a) pressurizing the liquefied natural gas to a predetermined pressure;

(b) passing the pressurized liquefied natural gas through a first heat exchanger whereby the liquefied natural gas is vaporized;

(c) passing the vaporized natural gas through a second heat exchanger whereby the vaporized natural gas is heated to produce a first vaporous product;

(d) circulating a refrigerant as a working fluid in a closed circuit through the first heat exchanger to condense the refrigerant and to heat the liquefied gas, through a pump to pressurize the condensed refrigerant, through a second heat exchanger in which heat is absorbed from a heat source to vaporize the pressurized refrigerant, and through a work-producing device to generate energy;

(e) compressing boil-off vapor by a first compression means;

(f) passing the compressed boil-off vapor through the first heat exchanger to cool the boil-off vapor and to heat the liquefied gas; and (g) further compressing the boil-off vapor by a second compression means and passing the compressed vapor from the second compression means through the second heat exchanger to heat the boil-off vapor to produce a second vaporous product.

2. The process of claim 1 wherein the cooled boil-off vapor of step (f) is further compressed by a third compression means and the further compressed boil-off vapor is passed through the first heat exchanger for re-cooling of the boil-off vapor prior to step (g).

3. The process of claim 1 wherein the boil-off vapor of step (e) has a pressure above about 1,724 kPa (250 psia) and a temperature between about −80° C. (−112° F.) and −112° C. (−170° F.).

4. The process of claim 1 wherein the pressurized liquefied natural gas to be regasified has an initial pressure above about 1,724 kPa (250 psia) and an initial temperature between about −80° C. (−112° F.) and −112° C. (−170° F.).

5. The process of claim 1 wherein the heat source for the second heat exchanger is water.

6. The process of claim 1 wherein the heat source for the second heat exchanger is a warm fluid selected from the group consisting essentially of air, ground water, sea water, river water, waste hot water and steam.

7. The process of claim 1 wherein the refrigerant comprises a mixture of hydrocarbons having 1 to 6 carbon atoms per molecule.

8. The process of claim 1 wherein an electric generator is coupled to the work-producing device to drive an electrical generator.

9. A process for recovering the energy from natural gas having a liquid phase and a vapor phase and having a pressure greater than about 1,724 kPa (250 psia) and a temperature between about −80° C. (−112° F.) and −112° C. (−170° F.), which process comprises:

(a) compressing the gaseous phase in a first compression stage;

(b) cooling the pressurized vapor from the first compression stage in a first heat exchange means;

(c) compressing the cooled vapor from the first heat exchange means in a second compression stage to a product pressure;

(d) heating the pressurized vapor from the second compression stage in a second heat exchange means;

(e) increasing the pressure of said liquid phase to approximately the pressure of the gaseous phase of step (c);

(f) passing said pressurized liquid phase through the first heat exchange means and the second heat exchange means to warm said liquid and to cool the compressed vapor in steps (b) and to heat the compressed vapor in step (d), said liquid phase being at least partially vaporized by the first heat exchange means;

(g) circulating in a closed power cycle through the first and second heat exchange means a first heat-exchange medium comprising the steps of (h) passing to the first heat exchange means the first heat-exchange medium in heat exchange with the gaseous phase of step (b) and in heat exchange with the liquid gas of step (g) to at least partially liquefy the first heat-exchange medium;

(i) pressurizing the at least partially liquefied first heat-exchange medium by pumping;

(j) passing the pressurized first heat-exchange medium of step (i) through the first heat exchange means to at least partially vaporize the liquefied first heat-exchange medium;

(k) passing the first heat-exchange medium of step (j) to the second heat exchange means to further heat the first heat-exchange medium to produce a pressurized vapor;

(l) passing the vaporized first heat-exchange medium of step (k) through an expansion device to expand the first heat-exchange medium vapor to a lower pressure whereby energy is produced;

(m) passing the expanded first heat-exchange medium of step (l) to the first heat exchanger and repeating steps (h) through (m); and (n) passing a second heat exchange medium through the second heat exchange means thereby heating the gaseous phase of step (d), heating the at vaporized gas of step (f), and heating the first heat exchange medium of step (k).

10. A process for regasifying a liquid gas with simultaneous production of energy, comprising the steps of:

(a) recovering boil-off vapor in the storage and/or handling of a liquid gas;

(b) compressing the boil-off vapor;

(c) cooling the compressed boil-off vapor in a first heat exchanger;

(d) further compressing the compressed boil-off vapor;

(e) heating the compressed boil-off vapor of step (d) in a second heat exchanger;

(f) pressurizing the liquid gas to be regasified;

(g) passing the pressurized liquid gas to the first heat exchanger wherein the pressurized liquid is heated in part by the compressed boil-off vapor of step (c), the pressurized liquid gas being at least partially regasified in the first heat exchanger;

(h) passing the pressurized gas resulting from step (g) to a second heat exchanger to further heat the pressurized gas resulting from step (g) and to produce a pressurized gaseous product;

(i) passing to the first heat exchanger in a closed cycle a first heat-exchange medium in heat exchange with the boil-off vapor of step (c) and in heat exchange with the liquid gas of step (g) to at least partially liquefy the first heat-exchange medium;

(j) pressurizing the at least partially liquefied first heat-exchange medium by pumping;

(k) passing the pressurized first heat-exchange medium of step (j) through the first heat exchanger to at least partially vaporize the liquefied first heat-exchange medium;

(l) passing the first heat-exchange medium of step (k) to the second heat exchanger to further heat the first heat-exchange medium to produce a pressurized vapor;

(m) passing the vaporized first heat-exchange medium of step (l) through an expansion device to expand the first heat-exchange medium vapor to a lower pressure whereby energy is produced;

(n) passing the expanded first heat-exchange medium of step (m) to the first heat exchanger and repeating steps (i) through (n); and (o) passing a second heat exchange medium through the second heat exchanger thereby heating the boil-off gas of step (e), heating the gas of step (h), and heating the first heat exchange medium of step (l).

* * * * *